US009914279B2

(12) United States Patent
Van der Kaap

(10) Patent No.: US 9,914,279 B2
(45) Date of Patent: Mar. 13, 2018

(54) DUNNAGE CONVERSION MACHINE AND METHOD WITH SEQUENTIAL STOCK ROLL STORAGE AND LOADING

(71) Applicant: Ranpak Corp., Concord Township, OH (US)

(72) Inventor: Jordy Van der Kaap, Spaubeek (NL)

(73) Assignee: RANPAK CORP., Concord Township, OH (US)

( * ) Notice: Subject to any disclaimer, the term of this patent is extended or adjusted under 35 U.S.C. 154(b) by 90 days.

(21) Appl. No.: 14/764,143

(22) PCT Filed: Jan. 27, 2014

(86) PCT No.: PCT/US2014/013207

§ 371 (c)(1),
(2) Date: Jul. 28, 2015

(87) PCT Pub. No.: WO2014/117091

PCT Pub. Date: Jul. 31, 2014

(65) Prior Publication Data

US 2015/0360434 A1 Dec. 17, 2015

Related U.S. Application Data

(60) Provisional application No. 61/757,367, filed on Jan. 28, 2013.

(51) Int. Cl.
*B31D 5/00* (2017.01)
*B65H 16/02* (2006.01)
(Continued)

(52) U.S. Cl.
CPC ..... *B31D 5/0039* (2013.01); *B65H 16/021* (2013.01); *B65H 19/12* (2013.01);
(Continued)

(58) Field of Classification Search
CPC ..... B31D 5/0039; B31D 2205/0023; B31D 2205/0082; B65H 16/021; B65H 19/12; B65H 19/1857
(Continued)

(56) References Cited

U.S. PATENT DOCUMENTS 2,508,566 A * 5/1950 Dunton ..... B65H 16/021 140/92.2
2,685,418 A * 8/1954 Moore ..... B21C 47/34 242/561
(Continued)

OTHER PUBLICATIONS

International Search Report for PCT/US2014/13207.
International Preliminary Report on Patentability for PCT/US2014/13207.

*Primary Examiner* — Michael E Gallion
(74) *Attorney, Agent, or Firm* — Renner, Otto, Boisselle & Sklar, LLP

(57) ABSTRACT

A support for one or more rolls of sheet stock material includes a sloped support surface for supporting at least one roll, an operating stop toward a lower end of the support surface that defines an operating position at which a stock roll is held for paying out sheet stock material from the roll, and a holding stop. The holding stop extends above the support surface. The holding stop holds one or more rolls at a location spaced from the operating position, and is movable to allow a stock roll to move down the support surface, past the holding stop to the operating position.

8 Claims, 7 Drawing Sheets

(51) Int. Cl.
*B65H 19/12* (2006.01)
*B65H 19/18* (2006.01)

(52) U.S. Cl.
CPC . *B65H 19/1857* (2013.01); *B31D 2205/0023* (2013.01); *B31D 2205/0082* (2013.01)

(58) Field of Classification Search
USPC ..... 242/551
See application file for complete search history.

(56) References Cited

U.S. PATENT DOCUMENTS 3,219,206 A * 11/1965 Cocker, III ..... D02H 3/00 242/559.3
3,582,010 A * 6/1971 Whiteman ..... B65H 19/1821 156/250
3,977,617 A * 8/1976 Salmon ..... B65H 35/04 242/421.2
4,650,456 A * 3/1987 Armington ..... B31D 5/0047 242/557
4,744,526 A * 5/1988 Kremar ..... B21C 47/24 242/533
4,840,321 A * 6/1989 Focke ..... B65H 16/04 242/422.3
5,209,418 A * 5/1993 Alexander, III ..... B65H 16/10 242/558
5,393,009 A * 2/1995 Neri ..... B65H 19/12 242/559.3
5,505,406 A * 4/1996 Summey, III ..... B65H 19/126 242/563.1
5,755,082 A * 5/1998 Takahashi ..... B29D 22/00 53/139.5
5,893,530 A * 4/1999 Alexander, III ..... B65H 16/106 242/559
6,095,454 A * 8/2000 Simmons, Jr. ..... B31D 5/0047 242/559
6,820,837 B2 * 11/2004 Long ..... B65H 19/126 242/554.2
7,926,757 B2 * 4/2011 Fischer ..... B65H 16/06 242/559.2
2005/0241774 A1 * 11/2005 Hart ..... B65H 19/1852 156/502
2007/0170301 A1 * 7/2007 Morello ..... B65H 16/08 242/557

* cited by examiner

DUNNAGE CONVERSION MACHINE AND METHOD WITH SEQUENTIAL STOCK ROLL STORAGE AND LOADING

This application is a national stage application under 35 U.S.C. § 371 of International Application No. PCT/US2014/013207, filed Jan. 27, 2014, which claims the benefit of U.S. Provisional Application No. 61/757,367, filed Jan. 28, 2013, all of the aforementioned applications are hereby incorporated herein by reference.

FIELD OF THE INVENTION

This invention relates generally to a dunnage conversion system and method, and more particularly to improvements in a system and method for storing and loading rolls of sheet stock material to a dunnage conversion machine for conversion into a dunnage product.

BACKGROUND OF THE INVENTION

In the process of shipping an item from one location to another, protective packaging material is often placed in the shipping container to fill any voids and/or to cushion the item during the shipping process. Paper, which is biodegradable, recyclable and composed of a renewable resource, is a popular source of packaging material for environmentally-conscientious shippers, but other sheet materials also are used to make dunnage products.

Paper and other sheet stock materials often are supplied in a compact roll form for a conversion machine to convert into a relatively lower density dunnage product. The sheet stock material typically is supported on a spindle or axle that passes through the core of the roll with its ends projecting therebeyond for cradled receipt in respective laterally spaced apart spindle supports of a stock roll holder. The spindle supports may be provided, for example, directly on the frame of the cushioning conversion machine or on a mobile cart as shown in U.S. Pat. No. 5,123,889.

A stock roll typically is loaded from a position on the floor. An axle rod is inserted through a hollow core at the center of the stock roll, and the stock roll is then raised by grasping and lifting the ends of the axle rod where it projects from opposite ends of the stock roll. The loading operation is completed by lowering the projecting ends of the axle rod onto the laterally spaced apart spindle supports that have recesses for cradled receipt and retention of the axle rod.

The conversion machine generally is disposed above the floor, sometimes at or above head level, which makes loading a stock roll more difficult because of the greater height to which the stock roll must be lifted. Also, the machine may be positioned over a conveyor which may require the operator to reach over the conveyor when loading a stock roll. Moreover, in some installations a person other than the machine operator may be designated to lift and load stock rolls. In these situations, delay may arise when such person, or attendant, is not immediately available. Consequently, the operator must wait until such an attendant is available. The delay may be of considerable length when the attendant is busy with another task, such as loading a stock roll for another machine or machines.

SUMMARY OF THE INVENTION

The present invention provides a system and method with a supply of sheet stock material for a dunnage conversion machine. The supply includes support elements for multiple rolls of sheet stock material, and a way to position stock rolls for sequential use by a dunnage conversion machine without lifting the stock roll. The present invention thus makes it easier for an operator to maintain a supply of stock material for a dunnage conversion machine without lifting any stock rolls once several stock rolls have been loaded into the stock supply.

The present invention also provides a stock roll storage rack is used to support at least one and preferably a plurality of stock rolls at the same level as the stock roll holder of a cushioning conversion machine. This enables an operator to easily load the machine without having to lift the stock roll to the height of the stock roll holder and/or without having to wait for an attendant to lift and load a stock roll on the machine. Also, plural stock roll storage racks can be used interchangeably, whereby one can be loaded with stock rolls by an attendant while the other is used to load stock rolls onto the cushioning conversion machine.

Further features of the invention will become apparent from the following detailed description when considered in conjunction with the drawings.

DETAILED DESCRIPTION

While some efforts have been made to provide more rolls of sheet stock material in a convenient location relative to a dunnage conversion machine, such as U.S. Pat. No. 6,095,454; the present invention provides further improvements. In particular, the present invention provides a system and method that make it easier to advance a roll of sheet stock material from a storage position to an operating position.

Figure 1:
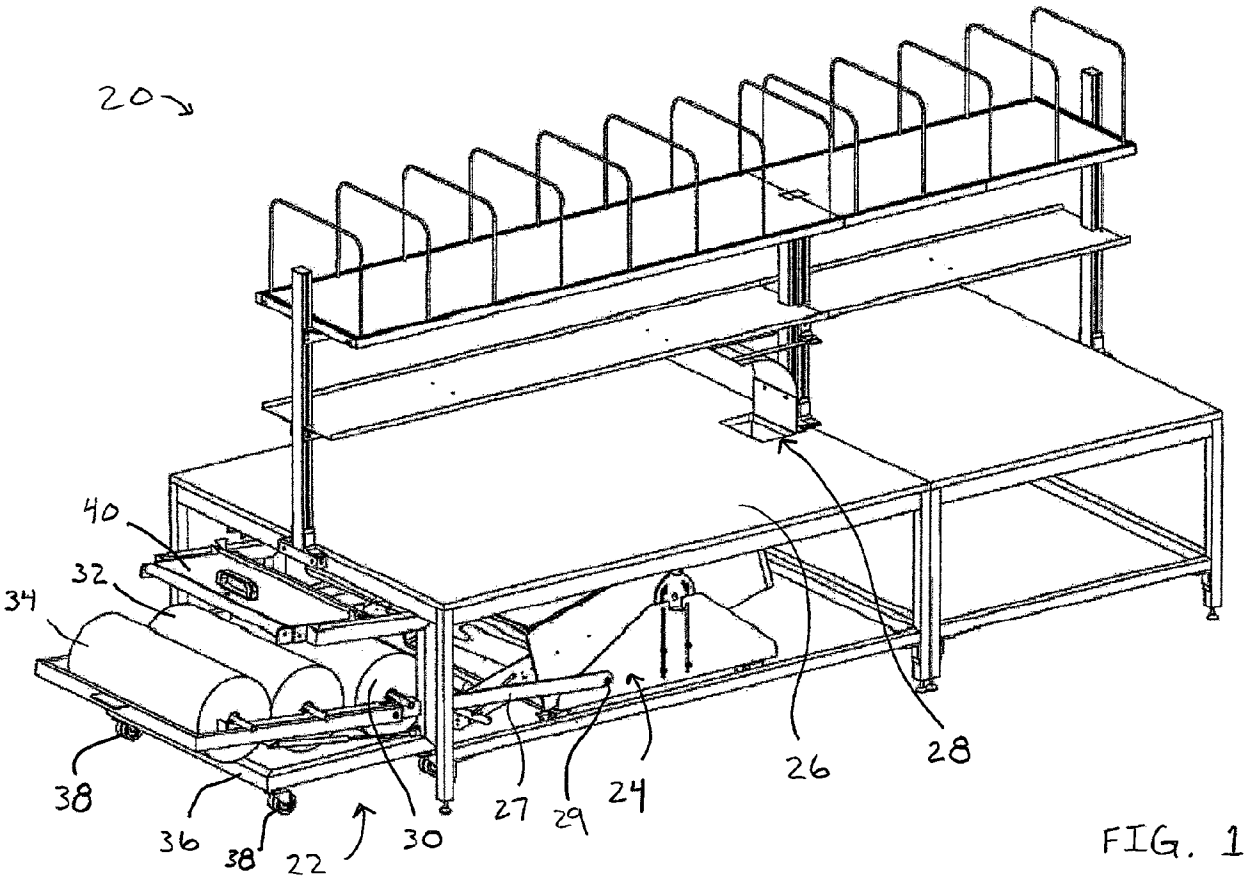
FIG. 1 is a perspective view of a dunnage conversion system having a stock roll storage and loading mechanism as provided in accordance with the present invention.
Figure 2:
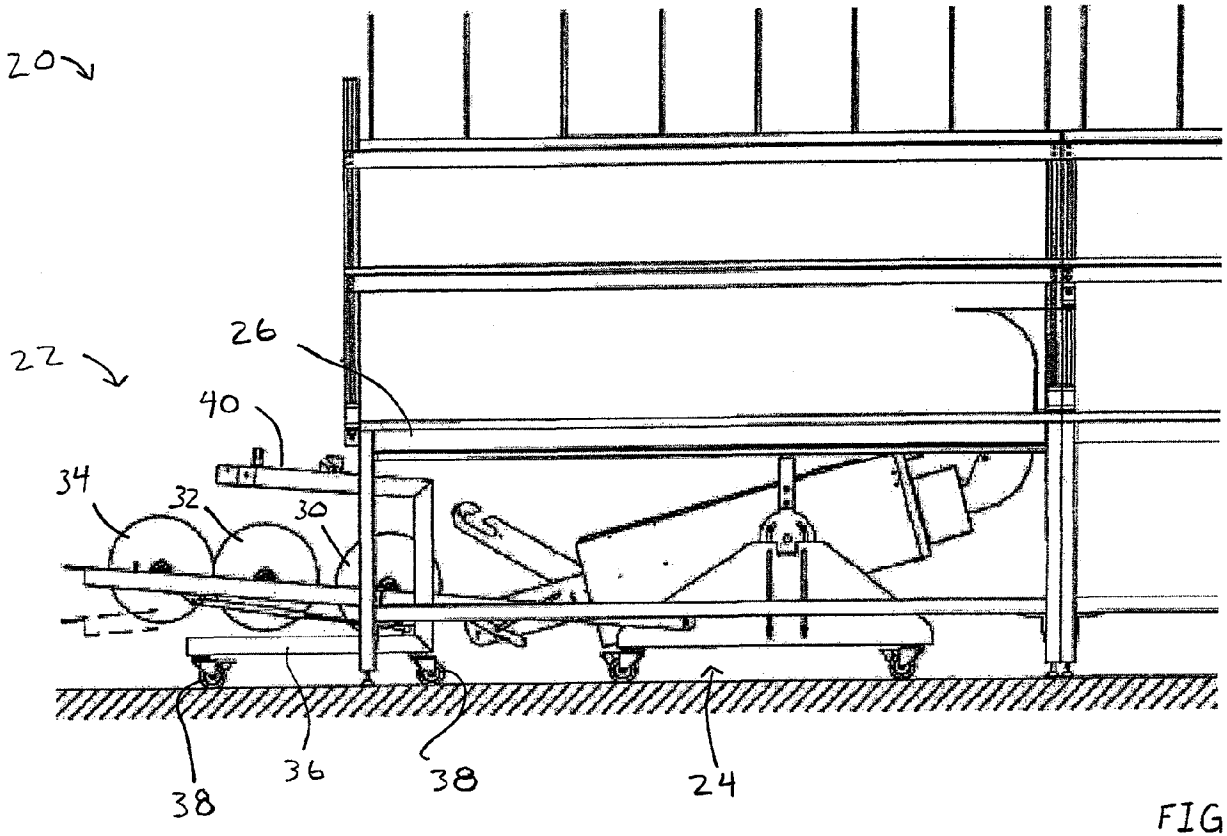
FIG. 2 is a side elevation view of the dunnage conversion system of FIG. 1.
Figure 3:
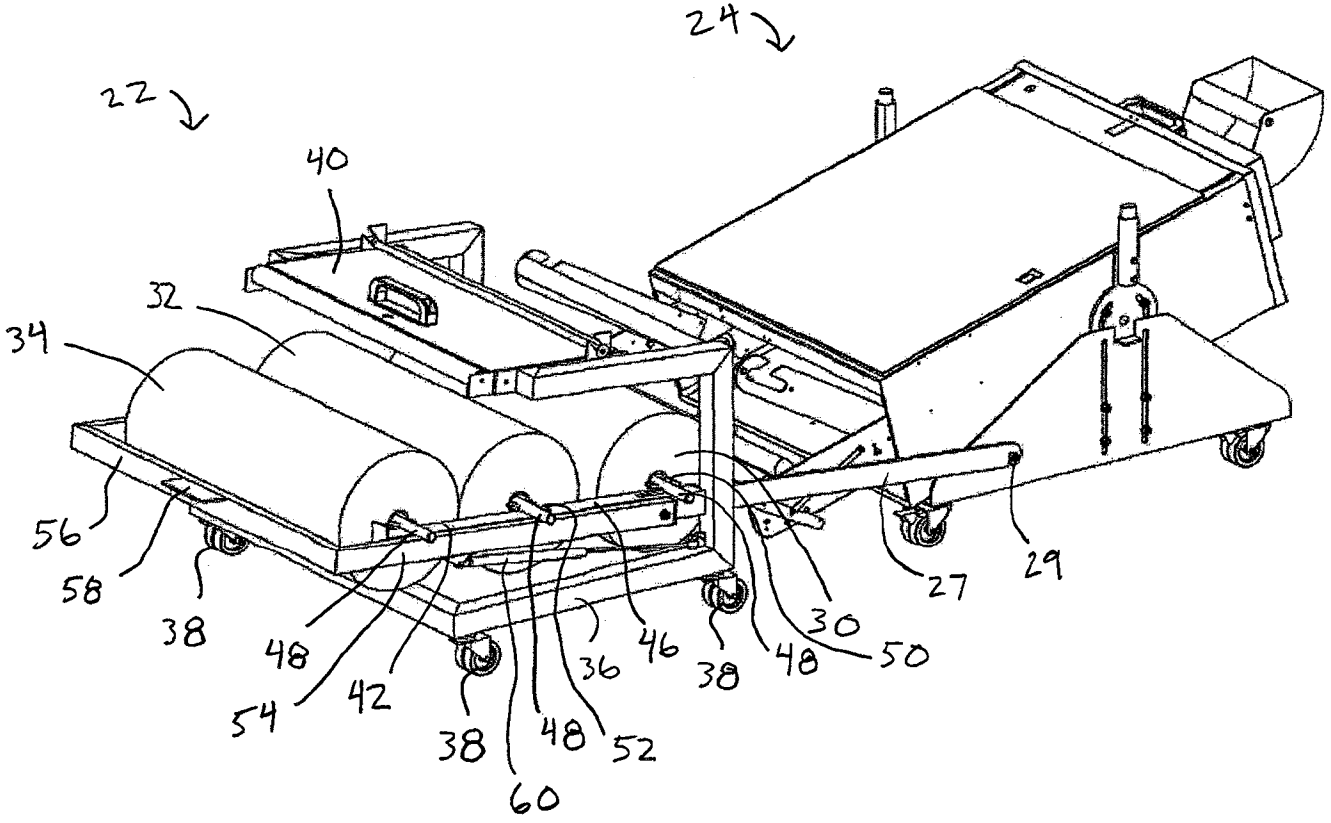
FIG. 3 is a perspective view of a portion of the dunnage conversion system of FIG. 1.
Figure 4:
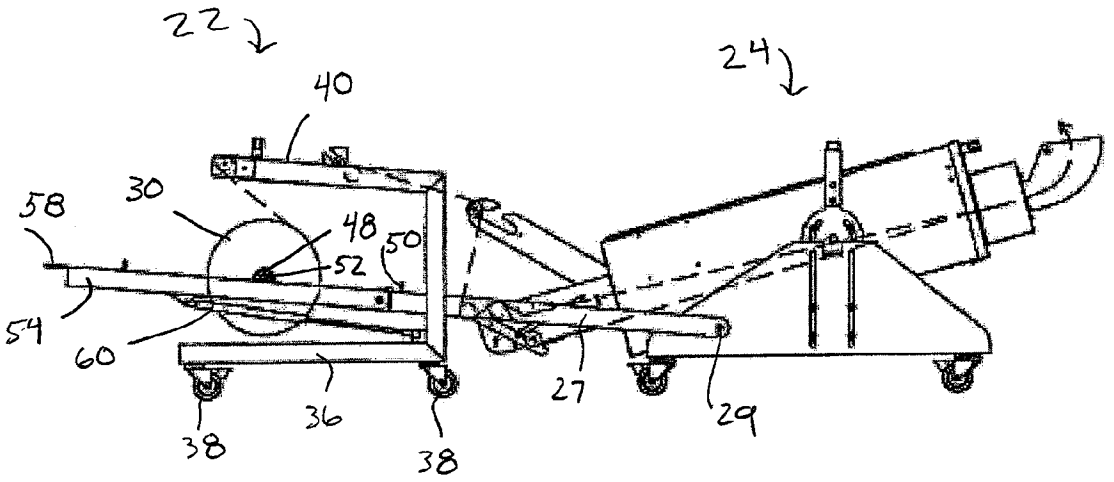
FIGS. 4-11 are sequential side elevation views of the dunnage conversion system of FIG. 3 illustrating the sequence of operations of the stock roll storage and loading mechanism provided by the present invention.
Figure 5:
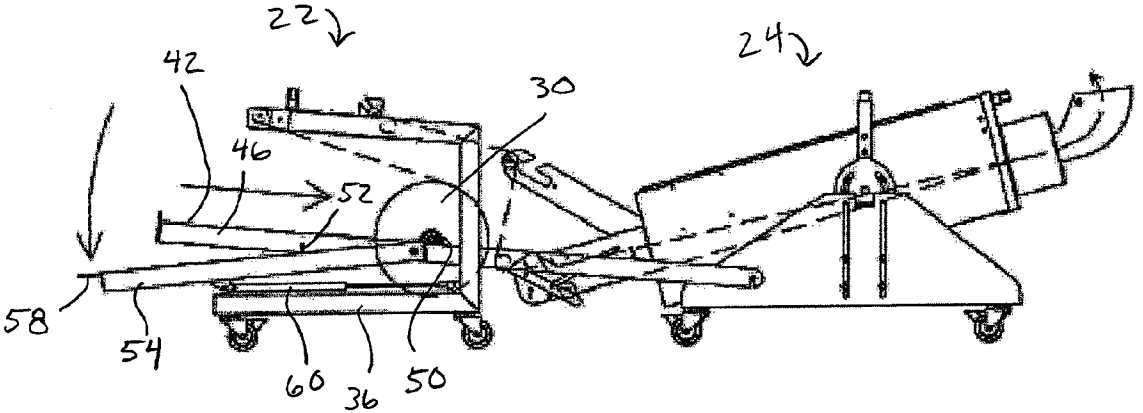
Figure 6:
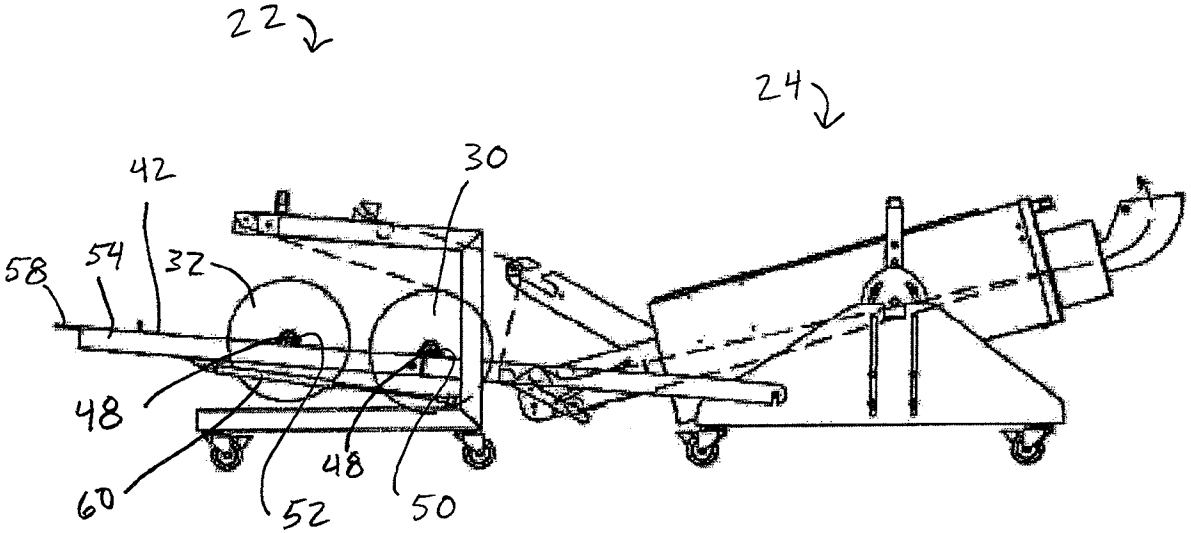
Figure 7:
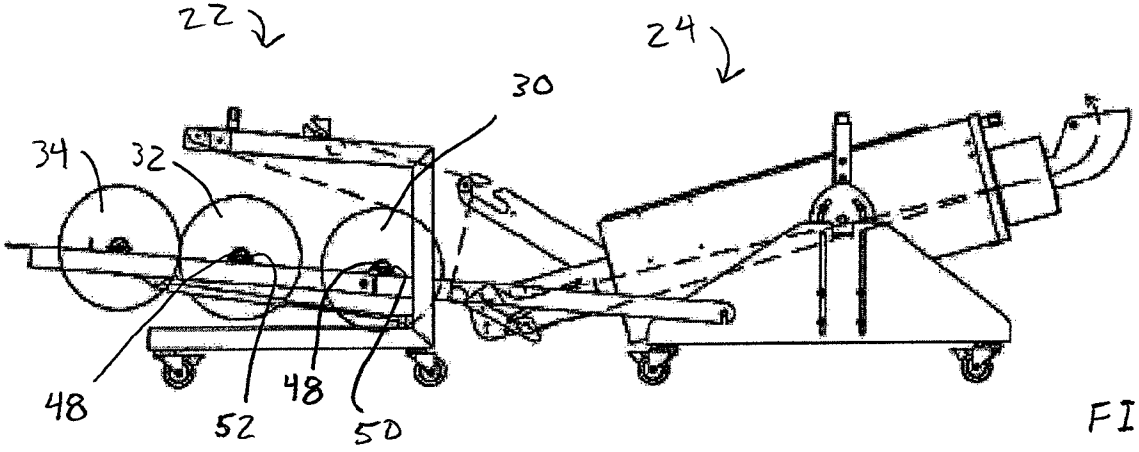
Figure 8:
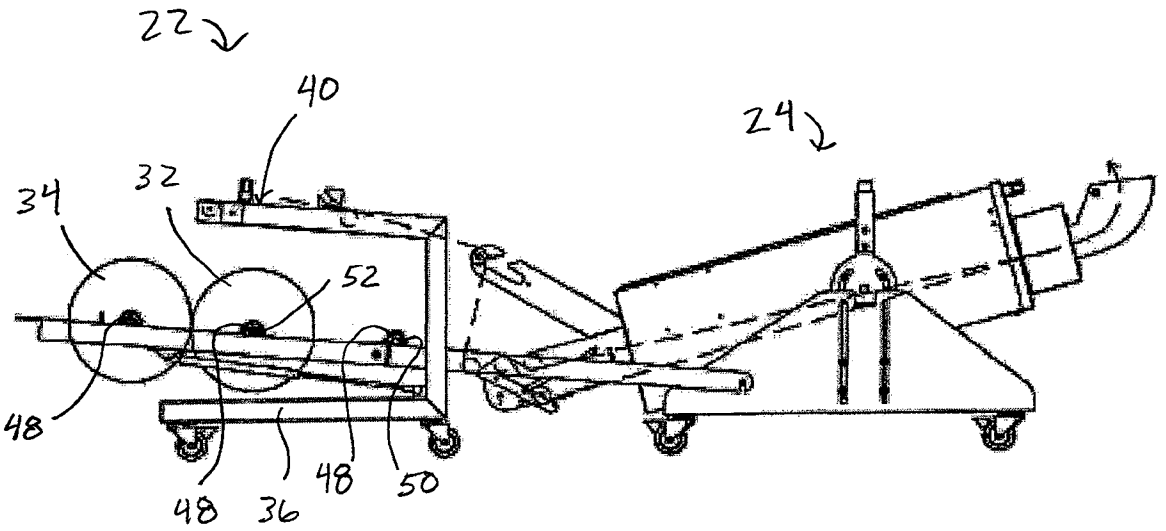
Figure 9:
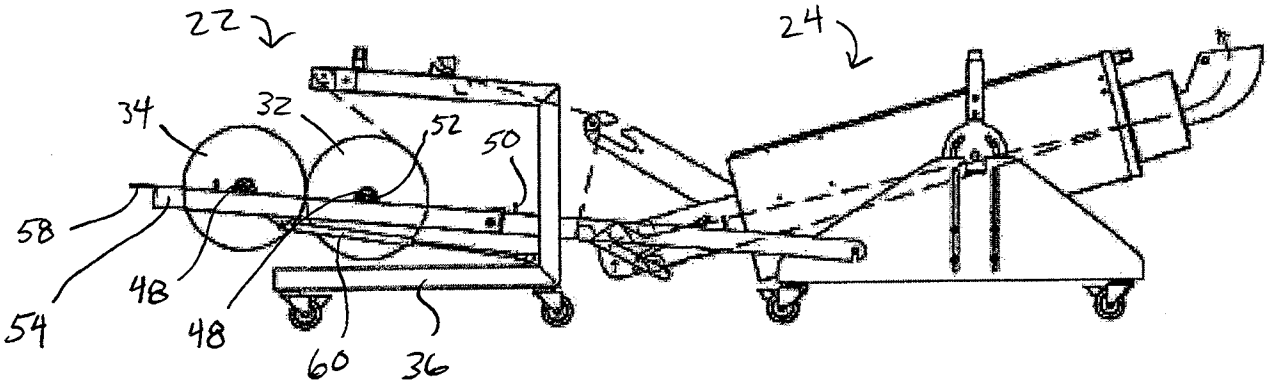
Figure 10:
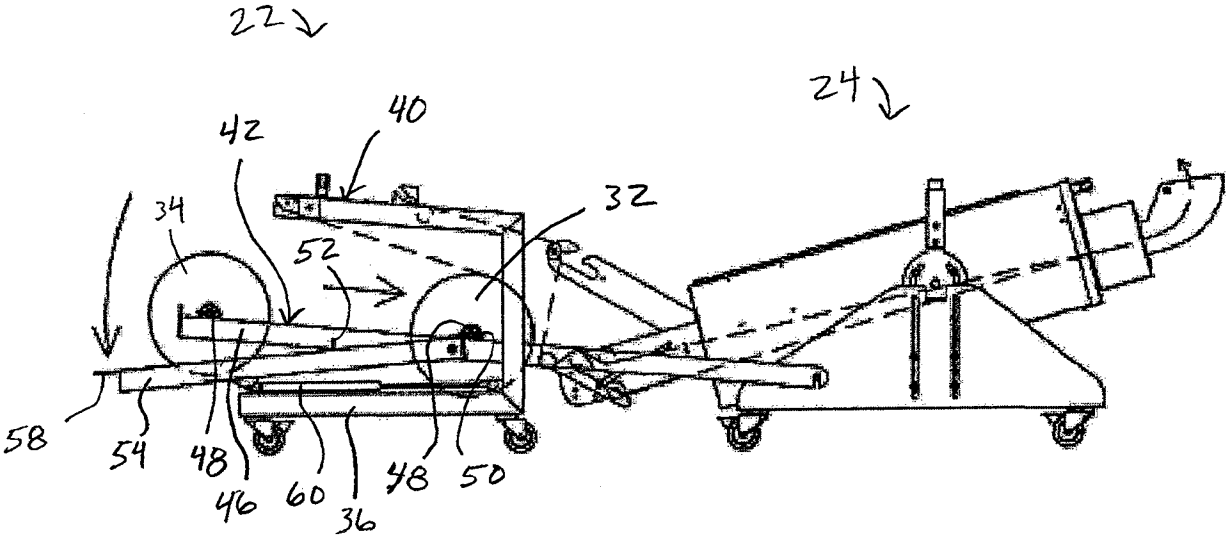
Figure 11:
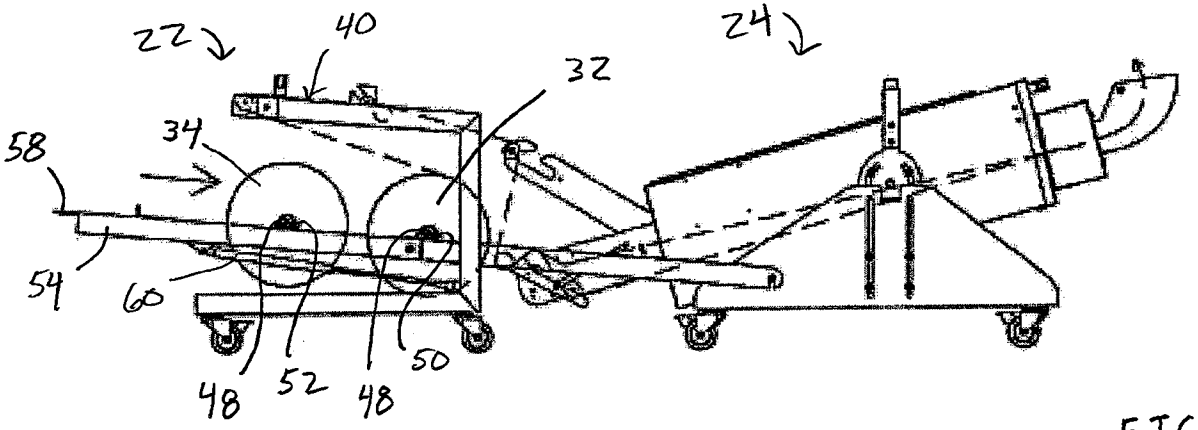

Referring now to the drawings and initially FIGS. 1-3, the present invention provides a dunnage conversion system 20 with a novel sequential stock roll storage and loading mechanism 22. In the drawings, the system 20 includes the stock roll storage mechanism 22, a dunnage conversion machine 24, and a packing table 26. In this embodiment, the dunnage conversion machine 24 and the stock roll loading mechanism 22 are designed to fit in a compact configuration underneath the packing table 26 so that dunnage can be dispensed from the dunnage conversion machine 24 up from below through an opening 28 in the packing table 26. Corresponding latch elements 27 and 29 couple the storage mechanism 22 and the dunnage conversion machine 24 a fixed distance apart. A hand or foot switch (not shown) can be used to control the production of dunnage from the dunnage conversion machine 24. The present invention is not limited to a stock roll loading and storage mechanism for use with a dunnage conversion machine that will fit underneath a packing table, however. An exemplary dunnage conversion machine is disclosed in U.S. Pat. No. 5,123,889, however, any type of dunnage conversion machine that converts a sheet stock material from a roll into a relatively lower density dunnage product can be used in accordance with the present invention.

The stock roll storage and loading mechanism 22 provided by the present invention can be loaded with multiple rolls 30, 32, and 34 of sheet stock material. An operator can sequentially move each roll 30, 32, and 34 into an operating position as needed. Consequently, an operator who is not able to lift a stock roll, which can be quite heavy, can operate the dunnage conversion system without assistance.

The illustrated stock roll storage and loading mechanism 22 supports a plurality of rolls 30, 32, and 34 of sheet stock material for supplying a dunnage conversion machine 24. The mechanism 22, or stock roll support, includes a frame 36 that defines a rack for supporting the stock rolls at an elevated position. In the illustrated embodiment, the frame 36 has wheels 38 to allow it to be moved where needed, and thus can be considered a cart 22. This stock roll cart 22 also supports a splicing plate 40, in this case mounted above a supporting surface 42 for the stock rolls 30, 32, and 34 to facilitate operator access to the splicing plate 40. The stock roll cart 22 also may include a sensor (not shown) for detecting an end of the sheet stock material so that the dunnage conversion machine 24 can be stopped before it completely runs out of stock material. This facilitates splicing a new supply of sheet stock material to the trailing end of the dispensed sheet stock material, which allows production of dunnage to resume much more quickly.

The stock roll cart 22 includes a surface 42 for supporting the multiple rolls 30, 32, and 34 of sheet stock material. In this embodiment, that support surface 42 is defined by a pair of spaced-apart support arms 46 upon which opposing ends of axles 48 extending through the stock rolls 30, 32, and 34 are supported. The stock roll support surface 40 is inclined. Consequently, the stock rolls 30, 32, and 34 will tend to roll down the incline. At one end of the stock roll support cart 22, a stop 50 is provided that defines an operating position from which sheet stock material is paid off a roll 30 and fed into the dunnage conversion machine 24. The remaining rolls 32 and 34 of sheet stock material are held at a holding position spaced from the stock roll 30 in the operating position. To that end, the stored stock rolls 32 and 34 are held by a holding stop 52 that prevents the stock rolls 32 and 34 from rolling down the incline support surface 42 to the operating position. This holding stop 52 protrudes above the stock roll support surface 42 to engage the axles 48 protruding from the ends of the stock rolls 30, 32, and 34.

The holding stop 52 is mounted to a pivotable holding arm 54 on each side of the stock roll support surface 40, and these arms 46 are connected by a cross member 56 with a handle or step 58 secured thereto so that both arms 46 can be moved as a single unit. These holding arms 54 are biased to a holding position, such as by a spring 60 or other biasing means, where the holding stop 52 is held above the stock roll support surface 42. Depressing these arms 54 using the handle or foot pedal stop 58 will drop the holding stop 52 below the stock roll support surface 42 and allow a stock roll to roll forward from the holding position toward the operating position.

Operation of the stock roll cart 22 provided by the present invention will now be described with reference to FIGS. 4-11. A shown in FIG. 4, an initial stock roll 30 is loaded onto the stock roll support surface 42, the stock roll being supported by an axle 48 extending through the stock roll such that its opposite ends are supported on the stock roll support surface 42. This axle 48 is held at the holding location by the holding stop 50. From there, the sheet stock material can be readily paid off of the stock roll around appropriate roller guides or guide members and across the splicing surface, from whence it is guided into the dunnage conversion machine 24 for conversion into a dunnage product. The dunnage product exits the dunnage conversion machine 24 at an outlet 62 thereof, and in the illustrated embodiment typically would be fed through the opening 28 in the packing table 26 (FIG. 1) for use by a packer on a packaging surface above the outlet 62 of the dunnage conversion machine 24.

The holding arms 54 can then be depressed to drop the holding stop 62 below the support surface 42 and allow the stock roll 30 to advance from the holding position to the operating position. The stock roll 30, via the axle 48 extending therethrough will roll down the sloped support surface 42 until it engages the operating stop 50 at the operating position. Once the stock roll 30 has advanced past the holding stop 52, the holding arms 54 can be released and the spring 60 will bias the holding arms 54 back to their holding position with the holding stop 52 extending above the support surface 42.

Additional stock rolls 32 and 34 can then be loaded onto the stock roll support surface 42 and stored there behind the holding stop 52, spaced from the stock roll 30 at the operating position, until they are needed. When the sensor detects that the end of the sheet stock material on the first roll 30 has come off the roll, the dunnage conversion machine 22 is stopped to leave a trailing end of the sheet stock material adjacent the splicing plate 40. Sheet stock material from the next roll 32 of sheet stock material can then be unwound and passed to the splicing plate 40 for splicing the leading end of the sheet stock material from the new roll 32 to the trailing end of the sheet stock material from the previous roll 30.

The holding arms 42 and cross member 56 can then be depressed once again, dropping the holding stop 52 below the support surface 42 and allowing the second stock roll 32 to advance to the operating stop 50 at the operating position. Any further stock rolls 34 remaining in the holding zone behind the holding stop 52 will then roll forward until they meet the holding stop 52, which again protrudes above the support surface 40 once the holding arms 54 have been released.

Accordingly, the stock roll cart 32 can be loaded in the morning, prior to the start of production, or at various times during the day as needed, by one or more workers who are able to lift the stock rolls 30, 32, and 34 onto the stock roll support surface 42. During the day and during normal operation of the dunnage conversion machine 22, however, an operator can continue to operate the dunnage conversion machine 24 while consuming multiple rolls of sheet stock material, without having to stop and load heavy rolls of sheet stock material onto the cart 22 until all of the rolls 30, 32, and 34 of sheet stock material have been consumed. This is particularly important for operators who are not able to lift a roll of sheet stock material on their own, and for the use of rolls of sheet stock material that require more than one person to lift into position.

In summary, the present invention provides a stock roll support, such as the illustrated cart 22, that makes it easier to load stock rolls 30, 32, and 34 in the stock supply for a dunnage conversion machine 22. Once a day, multiple rolls 30, 32, and 34 can be loaded onto the support 22, and during the day the rolls 30, 32, and 34 can be sequentially advanced to an operating position without lifting them. The sheet material, preferably paper, runs over a splicing plate 40 before passing into the dunnage conversion machine 22. When a sensor detects the end of the stock material on the roll 30 at a location upstream of the splicing plate 40, the conversion machine 22 stops producing dunnage. Stock material from the new stock roll 32 is unwound sufficiently to splice a leading end of the stock material from the new roll 32 to the trailing end of the stock material from the previous roll 30. And the next stock roll is advanced by depressing a foot pedal 58, allowing the next roll 32 to roll to the operating position. The dunnage conversion machine 22 can then resume operation.

Accordingly, the present invention provides a support 22 for one or more rolls 30, 32, and 34 of sheet stock material that includes a sloped support surface 42 for supporting at least one roll, an operating stop 50 toward a lower end of the support surface 42 that defines an operating position at which a stock roll is held for paying out sheet stock material from the roll, and a holding stop 52. The holding stop 52 extends above the support surface 42. The holding stop 52 holds one or more rolls at a location spaced from the operating position, and is movable to allow a stock roll to move down the support surface 42, past the holding stop 52 to the operating position.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A support for one or more rolls of sheet stock material, comprising:

a sloped support surface for supporting at least one stock roll, an operating stop toward a lower end of the support surface that defines an operating position on the sloped support surface at which a stock roll is held for paying out sheet stock material from the roll, and a holding stop extending above the support surface for holding one or more rolls at a location on the sloped support surface spaced from and above the operating position, the holding stop being movable to allow a stock roll to move down the sloped support surface past the holding stop to the operating position;

wherein the holding stop is mounted to a holding arm that is pivotably movable between a holding position where the holding stop extends above the sloped surface and a release position where the holding stop drops below the sloped surface; where the support surface is defined by a pair of parallel, spaced-apart support arms that support respective opposite ends of axles extending from opposite sides of a stock roll; wherein the holding arm having a pivot axis through the pair of parallel spaced-apart support arms to pivot relative to the pair of parallel spaced-apart support arms.

2. A stock roll support as set forth in claim 1, where the holding arm is biased toward the holding position.

3. A stock roll support as set forth in claim 1, where the support includes a frame that supports the sloped support surface at an elevated position.

4. A stock roll support as set forth in claim 1, where the support includes wheels, forming a mobile cart.

5. A stock roll support as set forth in claim 4, where the cart includes a latching mechanism for coupling the cart to a dunnage conversion machine.

6. A stock roll support as set forth in claim 1, where a cross-member with a handle connects distal ends of the holding arm.

7. A stock roll support as set forth in claim 1, further comprising a splicing plate mounted to the stock roll support.

8. A stock roll support surface as set forth in claim 1, in combination with a packing table having an opening therein for receiving dunnage from a conversion machine mounted below the table.

* * * * *